United States Patent [19]

Tritch

[11] Patent Number: 4,989,800

[45] Date of Patent: Feb. 5, 1991

[54] TISSUE ROLL DISPENSER

[76] Inventor: Kim M. Tritch, Rte. 2, P.O. Box 335, Paragould, Ark. 72450

[21] Appl. No.: 416,507

[22] Filed: Oct. 3, 1989

[51] Int. Cl.[5] ..... B65H 19/00

[52] U.S. Cl. ..... 242/55.3; 242/55.53

[58] Field of Search ..... 242/55.2, 55.3, 55.53, 242/130, 134; 206/391; 221/308, 309

[56] References Cited

U.S. PATENT DOCUMENTS

| | | | |
|---|---|---|---|
| 840,702 | 1/1907 | Maloney | 242/55.3 |
| 920,589 | 5/1909 | LeBlanc | 242/134 X |
| 1,009,181 | 11/1911 | Ringrose | 242/55.3 |
| 1,462,333 | 7/1923 | Girard | 242/55.3 |
| 3,506,215 | 4/1970 | Krikorian | 242/134 |
| 4,113,195 | 9/1978 | Theunissen | 242/55.53 X |
| 4,447,015 | 5/1984 | Peterson | 242/55.2 |

*Primary Examiner*—Daniel P. Stodola
*Assistant Examiner*—Paul Thomas Bowen
*Attorney, Agent, or Firm*—H. Jay Spiegel

[57] ABSTRACT

The present invention relates to an improved tissue roll dispenser. Included as features of the improved tissue roll dispenser are a mounting plate, rotatable tissue holder adapted to hold a plurality of tissue rolls, the tissue roll holder mounted on the mounting plate. Placed over the tissue roll holder and attached to the mounting plate is a cover containing a locking device for preventing rotational movement of the tissue holder, a gauge means indicating when the tissue holder should be replenished and an access openings allowing the user to freely rotate the tissue holder when a tissue roll has been completely used and access tissue rolls on the dispenser.

7 Claims, 3 Drawing Sheets

TISSUE ROLL DISPENSER

BACKGROUND OF THE INVENTION

The present invention relates to an improved tissue roll dispenser that is designed to hold a plurality of rolls of bathroom tissue on a rotating member which may be selectively rotated to index a fresh roll of toilet tissue into an operative position. In the prior art, tissue roll dispensers are known. U.S. Pat. No. 4,199,078 to Ramirez discloses the concept of a tissue storage container wherein the stored tissue rolls are sequentially removable. However, the teachings of this patent do not include all of the features of the present invention including a rotatable tissue roll dispenser including gauge means for facilitating stock replenishment as well as the capability for storing a large number of tissue rolls.

SUMMARY OF THE INVENTION

The present invention relates to an improved tissue roll dispenser. The present invention includes the following interrelated aspects and features:

(a) In a first aspect, the present invention includes a circular tissue roll holder having a plurality of spindles for holding the tissue rolls, the spindles being connected at one end to a hub and connected at the other end to an outer ring portion. On the outer ring portion of the tissue holder are latches which operate to hold the tissue holder in place during use. Attached to the hub of the tissue roll holder is a handle which facilitates rotation by a user to selectively access the tissue rolls contained therein.

(b) Also included as a part of the present invention is a mounting plate which is adapted to be mounted onto a surface the mounting plate having an axle centrally located thereon. The tissue holder aforementioned is mounted on the axle such that the tissue holder can freely rotate about the axle thereby enabling a user to access the tissue rolls thereon.

(c) Also included in the tissue roll dispenser is a cover which attaches to the mounting plate and has openings therein and a locking device attached thereon. One opening on the cover allows a user to access the toilet tissue rolls on the tissue roll holder while a second opening acts as a gauge means to allow a user to determine when the tissue roll holder should be restocked with tissue rolls. The locking device attached to the cover operates to secure the tissue holder and prevent it from rotating when a tissue roll is accessible to user. Finally, the cover has a third opening which allows a user to access the handle mounted to the hub of the tissue roll holder so that the tissue roll holder may be more easily selectively rotated.

Accordingly, it is a first object of the present invention to provide an improved tissue roll dispenser.

It is a further object of the present invention to provide a tissue roll dispenser capable of holding a sufficient number of tissue rolls to avoid frequent replenishing of stock.

It is a yet further object of the present invention to provide a device that indicates to a user when the tissue roll holder should be replenished with new tissue rolls.

These and other objects, aspects and features of the present invention will be better understood from the following specific description of the preferred embodiment when read in conjunction with the appended drawing figures.

SPECIFIC DESCRIPTION OF THE PREFERRED EMBODIMENTS

Figure 1:
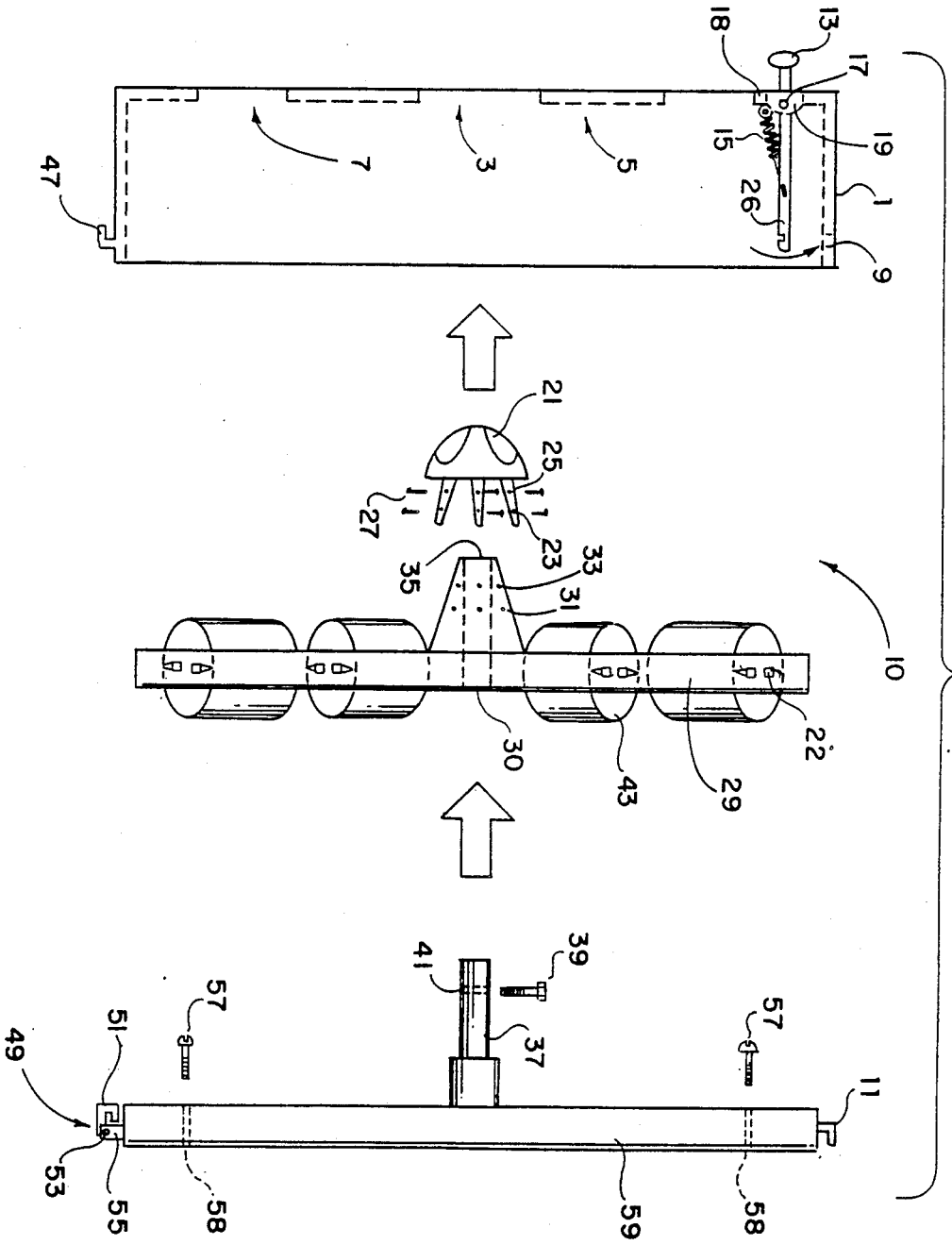
FIG. 1 shows an exploded side view of the present invention.

With reference to FIG. 1 firstly, an exploded side view of the present invention is shown and is generally designated by reference numeral 10. The drawing is seen to include a cover 1 having an opening 7 for accessing the tissue roll, opening 3 for receiving handle 21, opening 5 for gauging the need for replenishing the tissue roll stock, hook opening 9 and hook latch 47. Also included with the cover 1 is a locking device attached to said cover via a housing 19 at opening 18. The locking device has a shaft 26 with handle 13 which is pivotally connected to the housing 19 by pin 17. Spring 15 is attached on one end to housing 19 and that the other end to shaft 26. The spring 15 and shaft operate to lock the tissue roll device as will be described hereinafter.

The tissue roll holder 29 illustrated in FIG. 1 is depicted with tissue rolls 43 thereon and having a hub 31, the hub having an opening 35 and fastener openings 33. Handle 21 having legs 25 fits over hub 31 and is attached thereto by fasteners 27 inserted through openings 23 in legs 25 and openings 33 in hub 31. The handle 21 when mounted on hub 31 extends through opening 3 of cover 1 to allow a user to selectively rotate the tissue holder 29. Also shown as a part of tissue holder 29 are latches 22 which interact with locking device shaft to hold tissue holder 29 in place.

A mounting plate 59 is also depicted in FIG. 1 having an axle 37 with opening 41 therein, the axle centrally located on said mounting plate 59 to receive hub 31 of tissue holder 29 via opening 35. Once the tissue holder is mounted on axle 37, pin 39 is inserted into opening 41 to lock said tissue holder on the mounting plate 59 thereby allowing free rotation of the tissue holder. The mounting plate also has openings 58 and fasteners 57 for securing the mounting plate to a surface. As part of the mounting plate 59, a hook 11 and latching means 49 are shown. Hook 11 is adapted to be inserted into opening 9 of cover 1. Following this insertion step, latch means 49 having a latch 51 connected to member 55 by pin 53 is hooked onto hook 47 of cover 1 such that the cover 1 encloses tissue holder 29.

Figure 2:
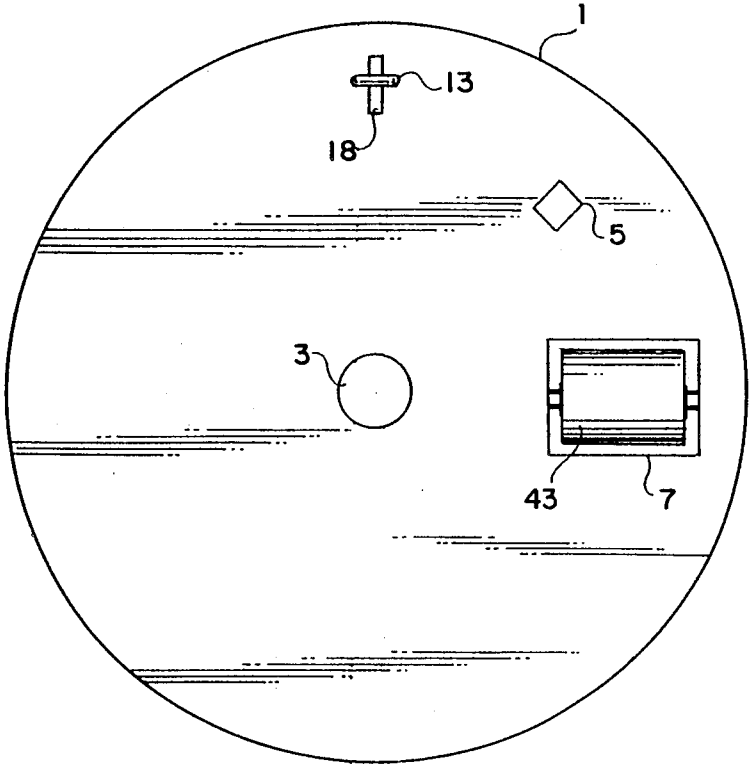
FIG. 2 shows a plan view of the cover of the present invention.

FIG. 2 illustrates the cover of the present invention more clearly depicting the location of the various openings therein. Opening 7 is shown with tissue roll 43 therein thereby illustrating how the tissue rolls are accessed through the cover 1. Opening 5 is located above opening 7 and positioned over a tissue roll adjacent the depicted tissue roll 43. Opening 5 acts as a gauging means to indicate to a user that the tissue roll in opening 7 is the last roll in the holder so that the tissue roll stock may be replenished.

Figure 3:
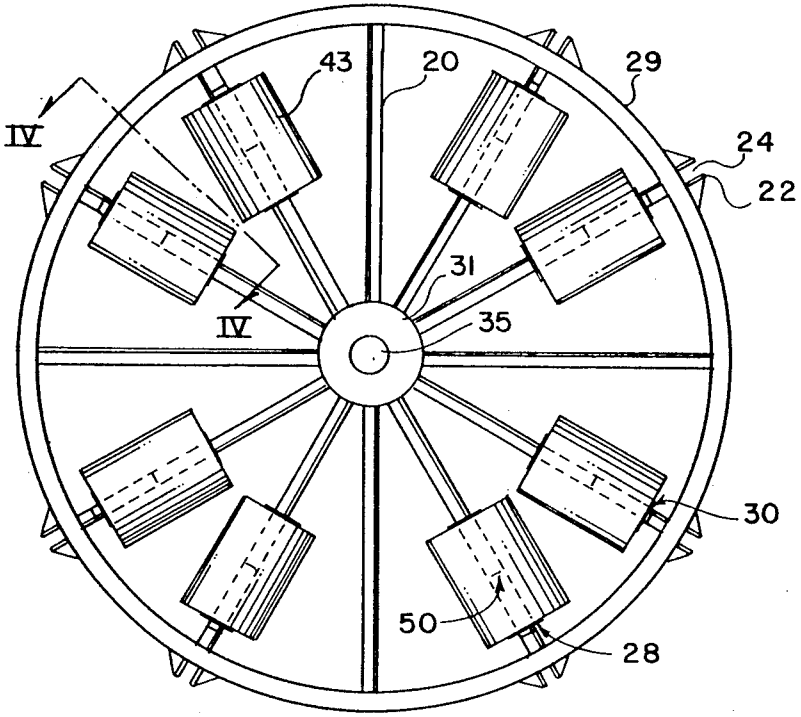
FIG. 3 shows a plan view of the tissue roll holder of the present invention.

FIG. 3 shows a plan view of tissue holder 29 depicting the circular configuration. In this embodiment, four main spindles 30 are shown extending between the rim and hub of holder 29 with eight spindles 50 retaining the tissue rolls 43. Also shown in FIG. 3 are latches 22 forming a channel 24 therein for receiving shaft 26 of the locking device.

Figure 4:
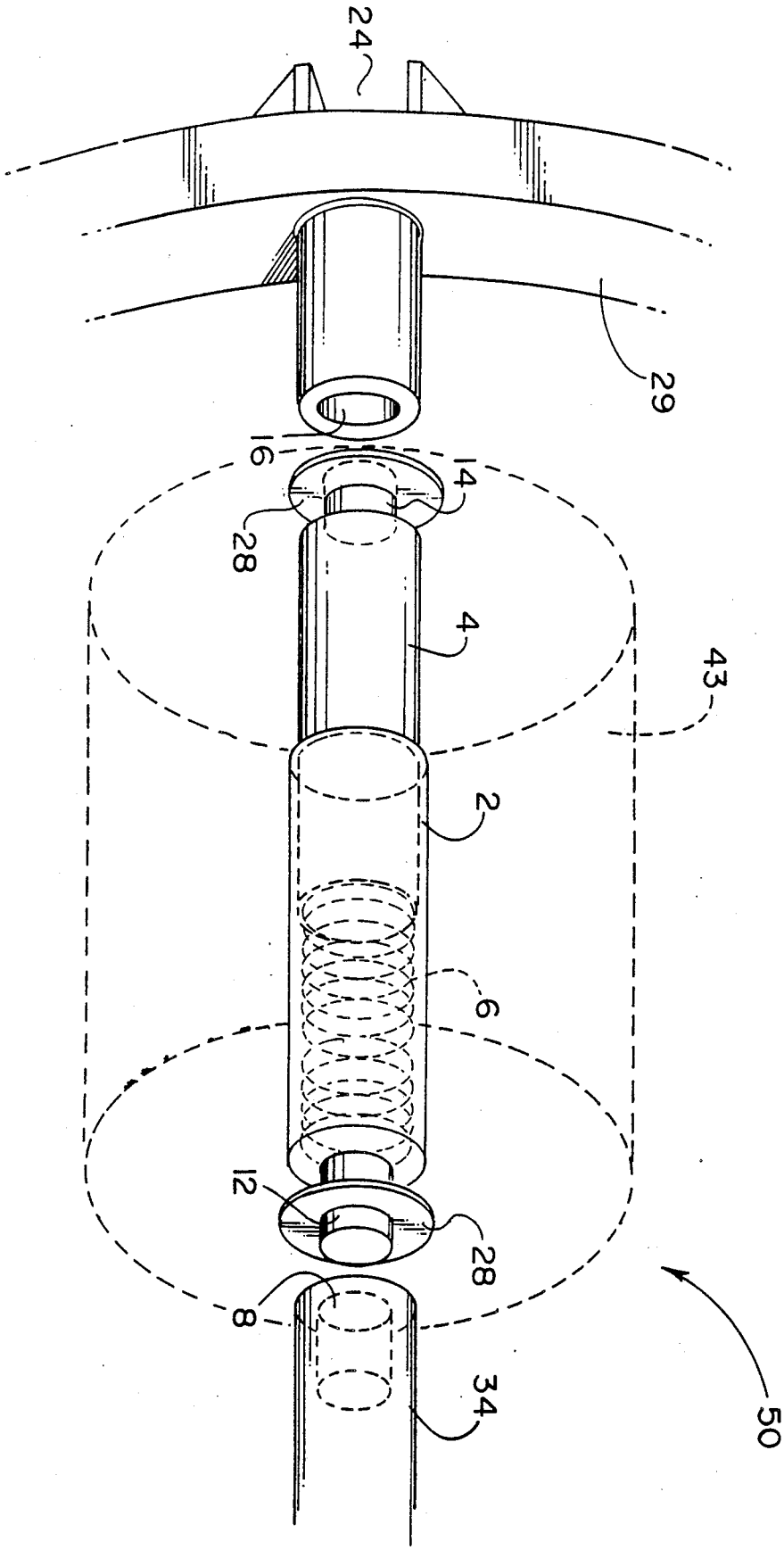
FIG. 4 shows a sectional view along line IV—IV of FIG. 3.

FIG. 4 shows a sectional view along the line IV—IV of FIG. 3 depicting the spindle 50. As can be seen from the drawing, spindle 50 has a portion 34 connected to the hub of holder 29 (not shown), spindle portion 34 having an opening 8 therein. Adapted to fit into opening 8 is an extension 12 of outer hollow member 2 of the spindle 50. Within member 2 is a spring 6, the spring being compressed by inner roll member 4. Inner member 4 has an extension 14 thereon for extending into opening 16 in tissue holder 29. The extensions 12 and 14 have washers 28 thereon in such a manner as to prevent the tissue rolls 43 from sliding on the spindles 50 and to position the rolls 43 for proper gauging and access by a user.

In operation, tissue holder 29 is stocked with tissue rolls by removing roll members 4 and 6. Members 4 and 6 are removed by grasping and moving member 4 such that spring 6 is compressed and extension 14 is withdrawn from opening 16. After removal of members 4 and 6, tissue rolls are placed thereon and the members including the tissue rolls are inserted back in openings 8 and 16 in the same manner as described hereinabove for removal. Once the tissue holder is loaded with tissue rolls, it may be mounted as described hereinabove on mounting plate 59 which has already been mounted to a surface. At this point, tissue holder 29 may freely rotate about axle 37 by handle 21. Cover 1 is then hooked onto mounting plate 57 via hook 11 and opening 9 and latch means 49 as described above. Once loaded, the tissue holder is locked in place by locking device shaft 26 resting in channel 24 formed by latches 22. When the tissue roll located in the opening 7 has been used, a user pulls down on handle 13 of the locking device thereby extending spring 15 and removing shaft 26 from channel 24, thereby allowing clockwise rotation of tissue holder 29 via handle 21 such that the next tissue roll may be positioned in opening 7. The handle 13 may then be released such that spring 15 pulls shaft 26 back into channel 24 and between latches 22, thereby preventing further rotation of the tissue holder 29.

Once tissue gauge opening 5 indicates the absence of any further tissue rolls, the cover may be removed and the spindles holding the tissue rolls may be restocked. Of course, gauge opening 5 may be located in other areas that would indicate to a user that the tissue roll holder should be restocked.

Although the drawings depict spindles for holding eight tissue rolls, different numbers of spindles may be used such as four or six. The tissue holder device may be made from metallic or nonmetallic material or a combination of both. Although the dimensions may vary, a preferred diameter for the tissue holder is approximately 30 inches with a cover height of six inches.

The improved tissue holder of the present invention offers many advantages over prior art devices. The improved tissue roll holder provides a compact and functional storage device for holding large numbers of tissue rolls thereby eliminating a need for restocking or running out of tissue at unexpected times as is the case in other prior art devices. Furthermore, the cover and spindles facilitate easy replenishment of the tissue rolls.

As such, an invention has been disclosed in terms of a preferred embodiment thereof which fulfills each and every one of the objects of the present invention as set hereinabove and provides a new and improved tissue roll dispenser of great utility and novelty.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved tissue holder dispenser comprising:

(a) a mounting plate having an axle centrally located thereon;

(b) a rotatable tissue roll holder further comprising:

(i) an outer ring portion;

(ii) a hub portion, (iii) a plurality of first spindles connecting said outer ring portion and said hub, said first spindles providing structural support for said outer ring portion, and (iv) a plurality of second spindles detachably connected at one end to said outer ring portion and at the other end to said hub portion, each respective said second spindle adapted to receive and retain a tissue roll;

(c) wherein said hub portion is adapted to be mounted on said axle to allow rotation of said tissue roll holder; and (d) a cover having a first opening for accessing a said tissue roll and a second opening allowing rotation of said tissue roll holder, said cover being mountable on said mounting plate for enclosing said tissue roll holder.

2. The invention of claim 1, wherein said cover includes a locking means actuable for preventing rotational movement of said tissue roll holder.

3. The invention of claim 1, wherein said cover includes an opening for gauging the necessity of replenishing said tissue roll holder with said tissue roll.

4. The invention of claim 1, wherein said hub includes a handle attached thereon, said handle adapted to fit through said second opening of said cover to facilitate rotation of said tissue roll holder.

5. The invention of claim 1, wherein said plurality of second spindles comprises eight spindles.

6. The invention of claim 1, wherein each said second spindle includes a cylindrical portion comprising a first hollow member having a spring therein and a second member adapted to fit into said first member and compress said spring, said cylindrical portion being adapted to be removed from a said second spindle to allow replacement of a said tissue roll.

7. The invention of claim 1, wherein each said cylindrical portion includes washer means thereon to retain a respective said tissue roll on a respective said second spindle.

* * * * *